US006591655B2

(12) United States Patent
Scheerschmidt

(10) Patent No.: US 6,591,655 B2
(45) Date of Patent: Jul. 15, 2003

(54) APPARATUS FOR BENDING PIPES

(76) Inventor: Matthias Scheerschmidt, Schoenblickweg 18, D-87479 Pfronten (DE)

( * ) Notice: Subject to any disclaimer, the term of this patent is extended or adjusted under 35 U.S.C. 154(b) by 0 days.

(21) Appl. No.: 09/796,880

(22) Filed: Mar. 1, 2001

(65) Prior Publication Data

US 2001/0018841 A1 Sep. 6, 2001

(30) Foreign Application Priority Data

Mar. 3, 2000 (DE) ..... 100 10 110

(51) Int. Cl.[7] ..... B21D 7/024
(52) U.S. Cl. ..... 72/307; 72/388; 72/217
(58) Field of Search ..... 72/306, 307, 388, 72/387, 217, 319, 321, 149, 157

(56) References Cited

U.S. PATENT DOCUMENTS 3,742,749 A * 7/1973 Bondarenko et al. ..... 72/217
3,986,381 A * 10/1976 Shubin et al. ..... 72/217
4,910,984 A * 3/1990 Young et al. ..... 72/388
5,182,932 A * 2/1993 Ritter et al. ..... 72/217
5,197,320 A * 3/1993 Saegusa ..... 72/149
5,669,261 A * 9/1997 Castren ..... 72/307
5,852,945 A * 12/1998 Burger ..... 72/306

FOREIGN PATENT DOCUMENTS

DE 2353028 * 6/1974 ..... 72/306
GB 2203679 * 10/1988 ..... 72/307

* cited by examiner

*Primary Examiner*—Daniel C. Crane
(74) *Attorney, Agent, or Firm*—Collard & Roe, P.C.

(57) ABSTRACT

An apparatus for bending pipes comprising a bending unit and a bending finger as well as with an infeed unit and a unit for holding and moving the pipe that is to be bent. The bending unit comprises two symmetrically located bending dies, each of which has an annular groove open on the outside, between which the pipe is inserted during the bending operation. The bending finger is pivoted on a pivoted support and the axes of rotation of the support and the bending finger are parallel to each other.

17 Claims, 3 Drawing Sheets

APPARATUS FOR BENDING PIPES

BACKGROUND OF THE INVENTION

1. Field of the Invention

The invention relates to an apparatus for bending pipes, having a bending unit and a bending finger as well as an infeed unit and a unit for holding and moving the pipe that is to be bent.

2. The Prior Art

Apparatuses of this kind have been disclosed in practical operation. The purpose of the invention is to design an apparatus of the kind outlined above in such a way that it is suitable for universal use.

SUMMARY OF THE INVENTION

In the solution to this problem proposed by the invention, the bending unit comprises two parts, with two symmetrically located bending dies, each of which has an annular groove open on the outside. The pipe is inserted between the dies during the bending operation, while the bending finger is pivoted on a pivoted support and the axes of rotation of the support and the bending finger are parallel to each other.

The superimposition of the two rotating movements of the support and the bending finger makes it possible for the bending finger to describe a wide range of different paths, so that it can carry out very specific bending operations. The bending finger follows the path of the outline of the bending die to both sides to a very large extent. The two pivoted bearings pivot independently of each other in this context. This can be achieved by separate drives or an appropriate control device. A feeler can be attached to the axis of rotation of the bending finger in order to follow the control device.

In an advantageous development of the invention, the bending unit is pivoted around the longitudinal axis of the pipe that is to be bent. This makes it possible to bend the pipe in whatever direction is required, without having to turn the pipe. It is also very advantageous if the bending unit is located so that it can be moved in the longitudinal direction of the pipe that is to be bent. As a result of this longitudinal movement facility, the pipe can be bent at whatever place is required without having to move it.

The rotary and longitudinal movement facilities of the bending unit can be combined in this context, so that universal completion of the bending process for the entire pipe is possible.

In a particularly advantageous development of the longitudinal movement unit, a ball screw is provided for longitudinal adjustment of the bending unit. This guarantees particularly easy and exact adjustment of the bending unit in the longitudinal direction.

In another advantageous development of the invention, at least two superimposed bending dies are provided in the bending unit, the grooves of which have different bending radii. This means that different bending radii can be produced without it being necessary to reset the bending unit. The pipe that needs to be bent simply has to be inserted in the appropriate groove.

It is advantageous if the bending die with the larger bending radii is located at the outer, free end. In the case of two superimposed bending dies, it is particularly advantageous if the bending finger is located so that its height can be adjusted. This allows it to follow the relevant bending die precisely.

In a further development of the invention, the infeed unit for the pipe that is to be bent is pivoted and can be moved longitudinally, so that it can be used not only for feeding in the pipe but also for holding it during the bending operation and for longitudinal movement of the pipe.

This means that optimum handling of the pipe is guaranteed. It is also very advantageous if the infeed unit can be adjusted longitudinally when it is swivelled away from the pipe. This makes it possible for the infeed unit to move past the bending unit and to take hold of the pipe on the other side.

It is also very advantageous if the neighboring bending dies are opened at least slightly for longitudinal movement in relation to the pipe. As a result of this, the pipe continues to have one guide during the longitudinal movement operation, which is a particular advantage in the case of long pipes.

In another advantageous development of the invention, an opening is provided in the apparatus as an extension to the longitudinal axis of the pipe that is to be bent, into which a hose section attached to the pipe is inserted during at least part of the bending operation. This means that additional guidance is provided, particularly when bending the part of the pipe away from the hose section. A lever arm is preferably provided to insert the hose section in the opening, which guides the hose section into the opening when the pipe is being fed into the bending unit.

In another advantageous development of the invention, the end of a unit for transporting the pipes that are to be bent is placed in the area of action of the infeed unit. As a result, the infeed unit is able to take hold of a pipe that is to be bent in a simple way at the end of this transport unit and can feed it into the bending apparatus. It is very practical if a stop element is provided at the end of the transport unit.

One pipe is moved up against this stop in each case, so that a precise stand-by position is reached for pipe transfer.

It is particularly advantageous if the stop element is pincer-shaped, can be moved along the pipe and is able to push a clamped pipe in a longitudinal direction against a stop located there. This means that it is possible to adjust the pipe precisely, which is very advantageous for the purposes of further processing.

In accordance with a further development of the invention, the stop element has an opening that the pipe is able to engage. The stop element is preferably movable in the longitudinal direction of the pipe.

In another advantageous development of the invention, the stop element has a lateral recess in the area of the opening to accommodate an intermediate element between the pipe and an attached hose section. This makes it possible to use the stop element itself to adjust the pipe.

Preferably, the transport unit has at least two rows of transport shoes that are open at the top, in which the pipes are transported individually. This ensures that the pipes are guided exactly while they are being transported. At least one of the two rows can be adjusted transversely.

This makes it possible for the transport unit to be set to pipes of different lengths. It is also advantageous if a limit switch is located at the end of the transport unit, which stops the transport unit when a pipe reaches the end position. This guarantees that a predetermined pipe position is reached, which facilitates the transfer operation by the infeed unit considerably.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

DETAILED DESCRIPTION OF THE PREFERRED EMBODIMENT

Figure 1:
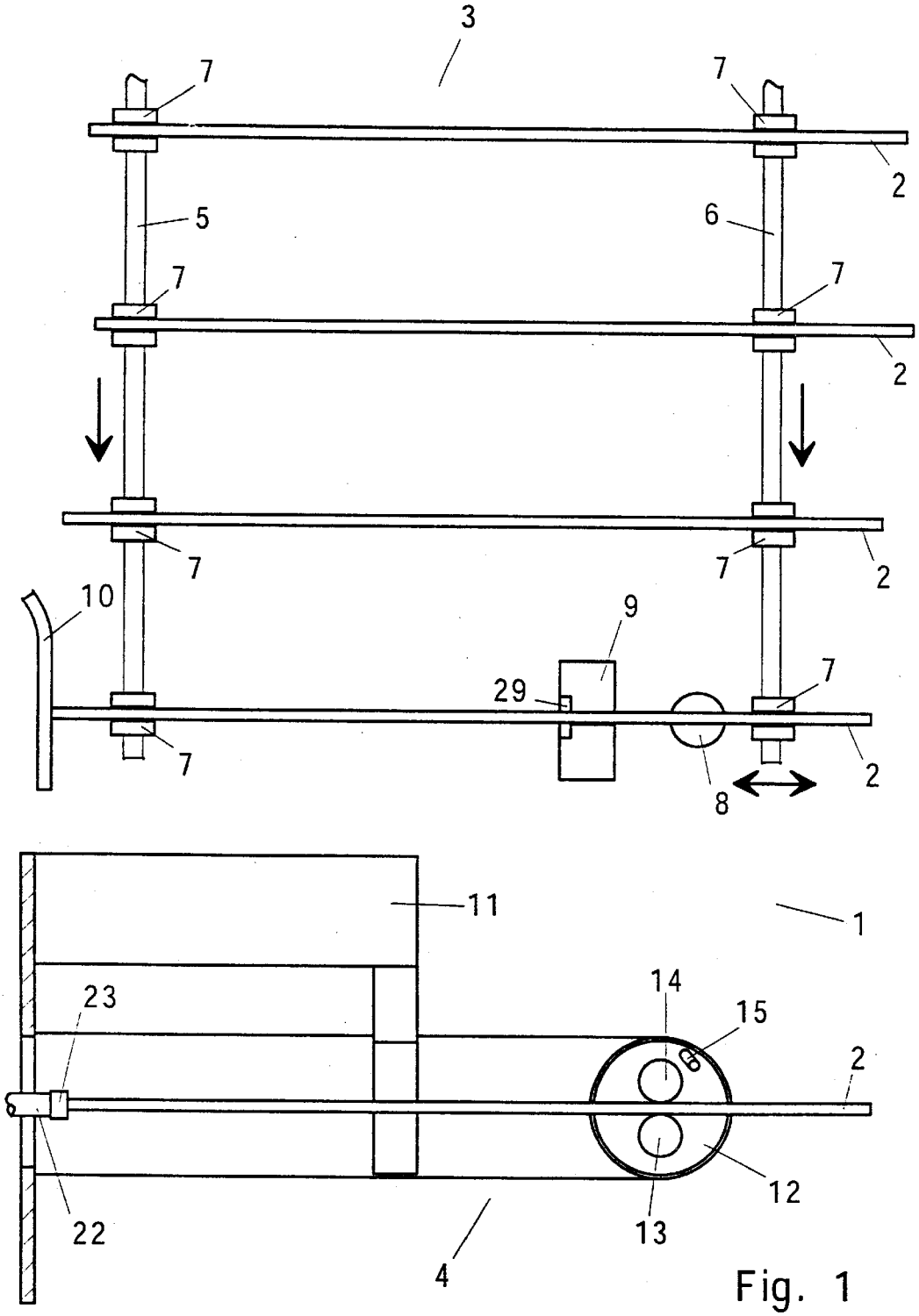
FIG. 1 is a diagrammatic top view of a bending apparatus with a bending unit and a transport unit according to the invention.

Referring now in detail to the drawings, FIG. 1 shows an apparatus for bending pipes 2 that includes a transport unit 3 and a bending unit 4. The transport unit 3 contains two transport chains 5 and 6, one transport chain 6 of which is laterally adjustable (double arrow). Transport shoes 7 which are open at the top and into which the pipes 2 are placed are located on the two transport chains.

A limit switch 8, that switches the drive of the transport unit off when a pipe 2 arrives, is provided at the end position facing the bending unit 4. At this end position there is also a stop element 9, into which the pipe 2 is transported. This stop element 9 has two jaws that can be moved together to clamp the pipe. The stop element 9 can also be moved parallel to the pipe 2, as a result of which it is able to push the end of the clamped pipe against a stop 10. This makes sure that each pipe is aligned precisely and can be transferred to the bending unit 4 without any problems.

For this purpose, an infeed unit 11 is provided on bending unit 4 and is pivoted on the bending unit. The radius of action of infeed unit 11 is such that it is able to take hold of the last pipe 2 in transport unit 3 and to bring this pipe into the bending unit. The infeed unit 11 can also be moved longitudinally, as a result of which pipe 2 can be moved within the bending unit.

Infeed unit 11 can also be moved longitudinally in an intermediate position swivelled away from the pipe, as a result of which it can move past a bending head 12 at the end of the bending unit and can take hold of the pipe on this side. A pipe 2 that is also provided at one end with a hose section 22, which is secured to pipe 2 by a connecting element 23, is shown in the drawing of the bending unit.

Stop element 9 has a recess 29 on the side that is engaged by connecting element 23 when stop element 9 is moved laterally, in order to align a pipe designed with a hose section in transport unit 3. The pipe is then aligned appropriately as well when stop element 9 is in a specified position. Bending head 12 of bending unit 4 is equipped with two bending dies 13 and 14 that are located opposite each other and are each provided with a groove around their circumference in which the pipe rests during the bending operation. A bending finger 15 is provided for bending purposes and is able to move along the outline of the circumferential groove of the bending die in each case. Bending finger 15 is configured as a pivoted, swivelling lever, while its bearing itself is in turn pivoted too. These two turning movements can be either activated independently of each other or controlled jointly via an appropriate control device.

Figure 2:
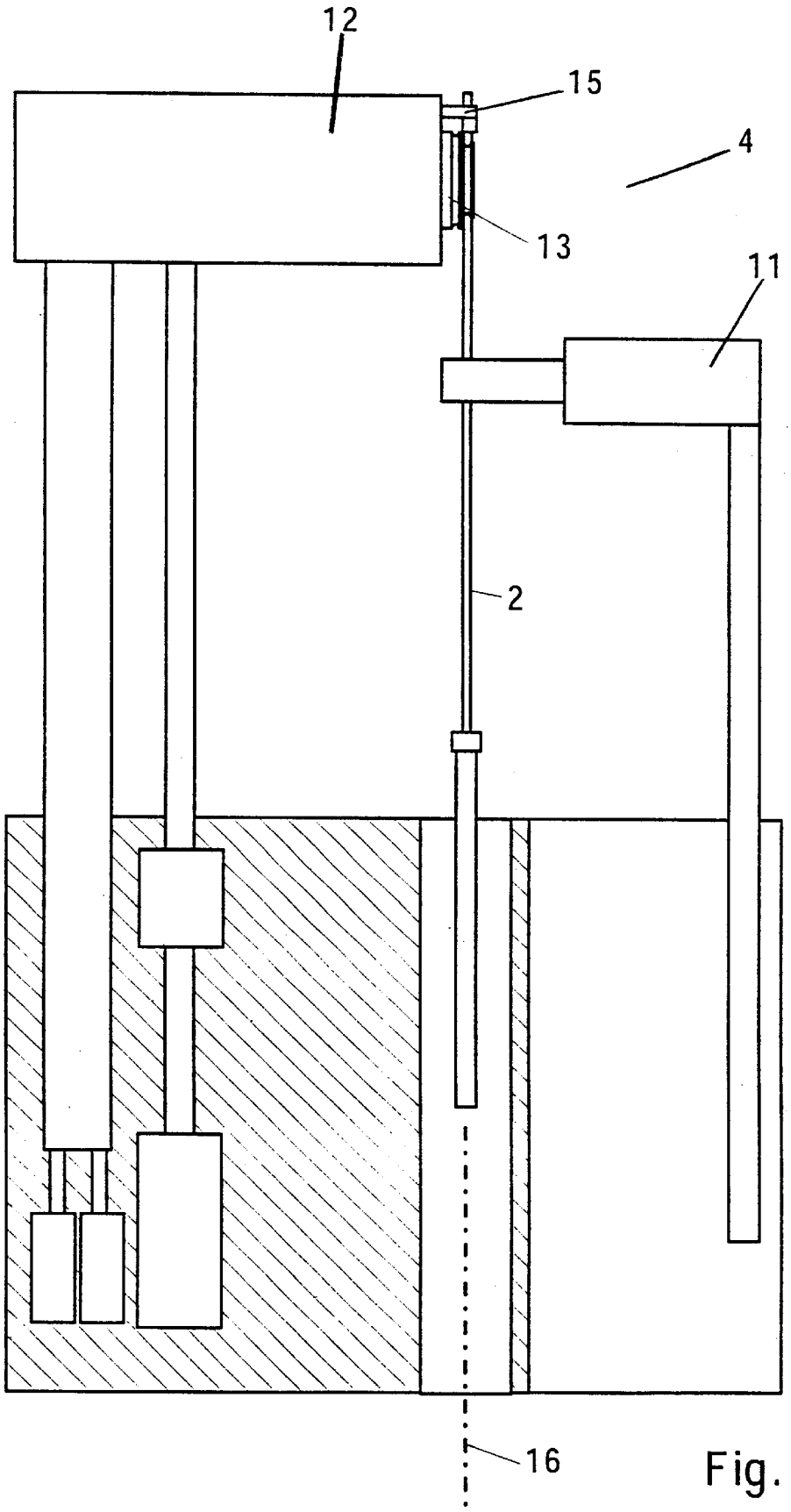
FIG. 2 is a diagrammatic view of the bending unit, some of it a cross-section.

The bending unit 4 with bending head 12 and infeed unit 11 is shown again in FIG. 2. Each of the bending dies 13 is equipped with two superimposed cams that have different diameters. Depending on the design of bending finger 15, the height of which can be adjusted, either the outer bending die or the inner bending die has a larger diameter than the other one. The bending head 12 and its drives can be turned around an axis 16, which the pipe is also in.

When the infeed unit 11 that is clamping the pipe is stationary, the bending head 12 can both move longitudinally into the relevant bending position and turn. Bending finger 15 then turns in the specified direction around one or other of the bending dies in accordance with the planned bending angle. To adjust the bending position, the two opposite bending dies 13 and 14 move apart, so that the bending head 12 can move towards the infeed unit that in turn is clamping the pipe 2 in position. If bending of this side of the pipe has already been completed and if bending has to be carried out on the other side of the infeed unit too, bending head 12 clamps the pipe, while the infeed unit 11 releases the pipe, swivels away from it and moves longitudinally to the other side of the bending head. When it reaches there, it swivels against the pipe again and clamps it securely. The bending head 12 can then move into the new bending position.

It is, however, also possible to adjust the pipe and infeed unit 11 only slightly in relation to each other. To do this, the clamping mechanism of infeed unit 11 is just released slightly and either infeed unit 11 moves away from bending head 12 or bending head 12 moves away from infeed unit 11.

Figure 3:
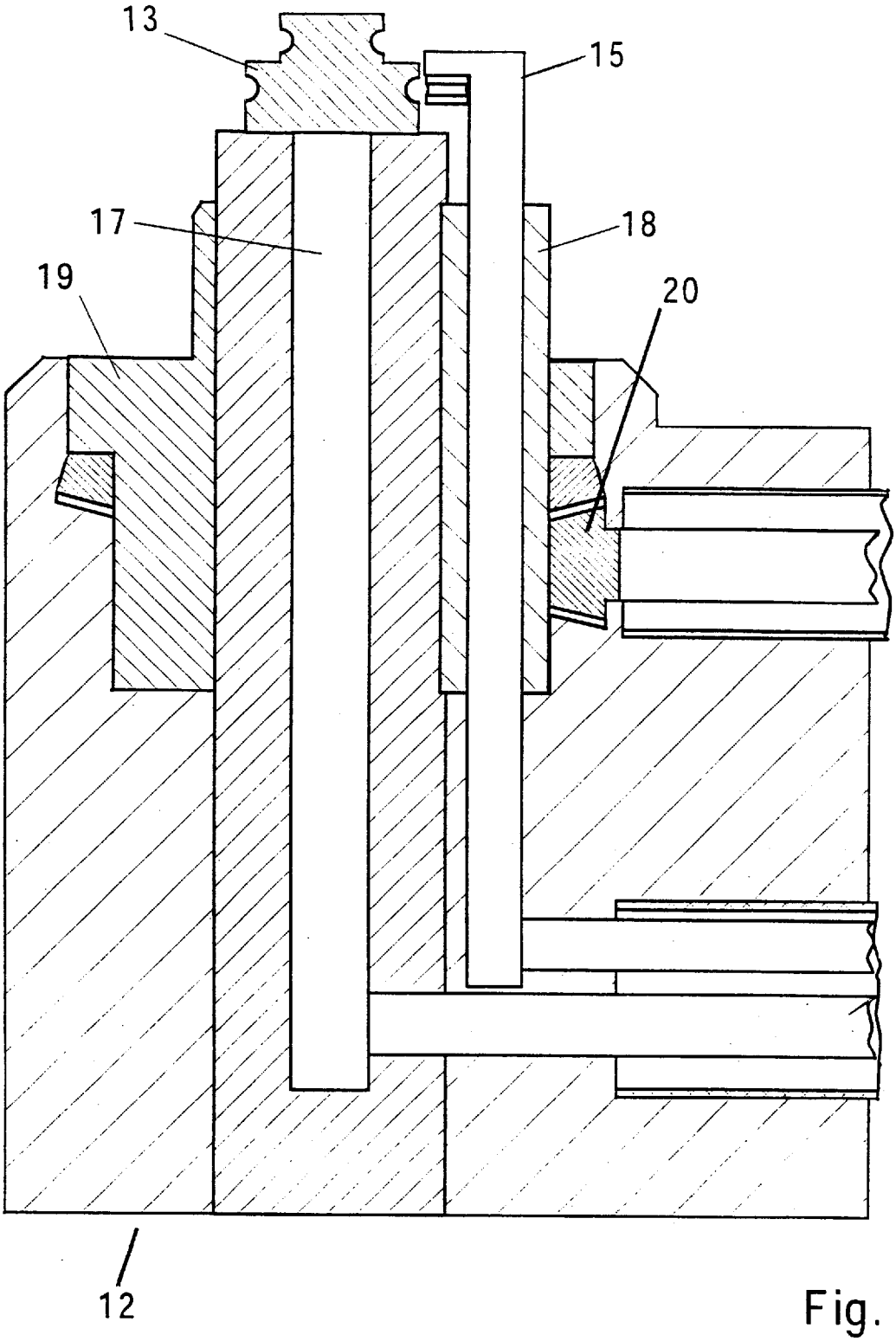
FIG. 3 is a cross-section of the bending unit.

Bending head 12 is shown in somewhat greater detail in FIG. 3. A double die 13 is located at the end of bending head 12, the upper section of which has a smaller bending radius than the lower section. In the drawing, bending finger 15 is interacting with the lower section, so that a pipe inserted in this operating mode would be bent with the larger scale. It is, however, possible for bending finger 15 to be moved out so that it is located next to and interacts with the section of the die with the smaller bending radius instead. Depending on the design of the bending finger, it is also possible to provide the upper section of the bending die with the larger bending radius.

Reference numeral 17 denotes a mechanism for lateral adjustment of the bending dies that is not shown in any greater detail in the drawing. The bending finger 15 is pivoted in a bearing 18. A bearing 19 is also provided in which bearing 18 of the bending finger 15 is pivoted. Bearing 19 is turned by a drive 20. This enables the bending finger to carry out two superimposed turning movements that can be actuated separately or jointly via an appropriate control device (which is not shown in the drawing).

Accordingly, while only a few embodiments of the present invention have been shown and described, it is obvious that many changes and modifications may be made thereunto without departing from the spirit and scope of the invention.

What is claimed is:

1. An apparatus for bending pipes, comprising a bending unit which comprises:

two symmetrically located bending dies, each die having an annular groove open on the outside and between which the pipe is inserted during a bending operation;

a bending finger connected to the unit and being pivoted on a pivoted support, wherein the axes of rotation of the support and the bending finger are parallel to each other; and an infeed unit connected to the bending unit for feeding the pipe to the bending dies, said infeed unit also comprising a unit for holding and moving the pipe that is to be bent, wherein the bending unit is adapted to be moved in a longitudinal direction of the pipe that is to be bent.

2. The apparatus according to claim 1, wherein the bending unit is pivoted around a longitudinal axis of the pipe that is to be bent.

3. An apparatus for bending pipes, comprising a bending unit which comprises:

two symmetrically located bending dies, each die having an annular groove open on the outside and between which the pipe is inserted during a bending operation;

a bending finger connected to the unit and being pivoted on a pivoted support, wherein the axes of rotation of the support and the bending Linger are parallel to each other; and an infeed unit connected to the bending unit for feeding the pipe to the bending dies, said infeed unit also comprising a unit for holding and moving the pipe that is to be bent, wherein the bending dies are superimposed and have grooves of different bending radii.

4. The apparatus according to claim 3, wherein the bending die with a larger bending radii is located at an outer, free end.

5. The apparatus according to claim 3, wherein the bending finger is height adjustable.

6. An apparatus for bending pipes, comprising a bending unit which comprises:

two symmetrically located bending dies, each die having an annular groove open on the outside and between which the pipe is inserted during a bending operation;

a bending finger connected to the unit and being pivoted on a pivoted support, wherein the axes of rotation of the support and the bending finger are parallel to each other; and an infeed unit connected to the bending unit for feeding the pipe to the bending dies, said infeed unit also comprising a unit for holding and moving the pipe that is to be bent, wherein the infeed unit is pivoted and is longitudinally movable, said infeed unit feeding in the pipe to be bent, holding the pipe during the bending operation and longitudinally moving the pipe.

7. The apparatus according to claim 6, wherein the infeed unit is longitudinally adjustable when said infeed unit is swivelled away from the pipe.

8. The apparatus according to claim 6, wherein the bending dies are opened at least slightly for longitudinal movement of the pipe.

9. An apparatus for bending pipes, comprising a bending unit which comprises:

two symmetrically located bending dies, each die having an annular groove open on the outside and between which the pipe is inserted during a bending operation;

a bending finger connected to the unit and being pivoted on a pivoted support, wherein the axes of rotation of the support and the bending finger are parallel to each other; and an infeed unit connected to the bending unit for feeding the pipe to the bending dies, said infeed unit also comprising a unit for holding and moving the pipe that is to be bent, and further comprising a unit for transporting the pipes that are to be bent, said transport unit connected at an end in an area of action of the infeed unit.

10. The apparatus according to claim 9, further comprising a stop element at the end of the transport unit.

11. The apparatus according to claim 10, wherein the stop element is pincer-shaped, can be moved along the pipe and is able to push a clamped pipe in a longitudinal direction against a stop.

12. The apparatus according to claim 10, wherein the stop element has an opening that the pipe engages.

13. The apparatus according to claim 12, wherein the stop element is movable in the longitudinal direction of the pipe.

14. The apparatus according to claim 13, wherein the stop element has a lateral recess in an area of the opening to accommodate an intermediate element between the pipe and an attached hose section.

15. The apparatus according to claim 9, wherein the transport unit has at least two rows of transport shoes that are open at the top, in which the pipes are transported individually.

16. The apparatus according to claim 15, wherein at least one of the two rows is transversely adjustable.

17. The apparatus according to claim 9, further comprising a limit switch at an and of the transport unit which stops the transport unit when a pipe reaches an end position.

* * * * *